US006821135B1

(12) United States Patent
Martin

(10) Patent No.: US 6,821,135 B1
(45) Date of Patent: Nov. 23, 2004

(54) ALIGNMENT PLATE FOR ALIGNING CONNECTOR TERMINALS

(75) Inventor: Galen M. Martin, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/635,118

(22) Filed: Aug. 6, 2003

(51) Int. Cl.[7] ..... H01R 13/44
(52) U.S. Cl. ..... 439/144; 439/141; 439/378
(58) Field of Search ..... 439/140, 141, 439/378, 374, 352

(56) References Cited

U.S. PATENT DOCUMENTS 3,651,444 A * 3/1972 Desso et al. ..... 439/141
4,832,613 A * 5/1989 Tsukakoshi ..... 439/141
5,222,907 A * 6/1993 Katabuchi et al. ..... 439/377
5,437,558 A * 8/1995 Sakuraoka et al. ..... 439/140
6,171,133 B1 * 1/2001 Altuner et al. ..... 439/381
6,409,525 B1 * 6/2002 Hoelscher et al. ..... 439/140

* cited by examiner

*Primary Examiner*—Tho D. Ta

(57) ABSTRACT

A socket and plug connector are shown where the socket connector has a plurality of tab terminals positioned on a printed circuit board, and a shroud in surrounding relation thereto. The shroud housing does not have a floor, and thus the shroud wall can extend to the printed circuit board. An alignment plate is positioned over the tab terminals and is movable from an upper position where the alignment plate member protects the tab terminals and holds them in an array, to a lower position where the alignment plate member floats to a position adjacent to the printed circuit board to receive the plug connector.

20 Claims, 9 Drawing Sheets

ALIGNMENT PLATE FOR ALIGNING CONNECTOR TERMINALS

FIELD OF THE INVENTION

The invention relates to a connector assembly comprised of a socket and plug assembly, particularly for automotive use.

BACKGROUND OF THE INVENTION

Automotive connection systems exist in the form of socket and plug connectors, where the socket connector includes a plurality of upstanding pins and/or tabs to provide a plurality of signal and/or power lines to various parts of the automobile. Many times harnesses must be assembled and/or preassembled, where one part of the connector is not mated with the corresponding connector until some time further in the overall automobile assembly process. Thus, this requires a great deal of care for socket connectors of the type having a header and a plurality of upstanding tabs and/or pins.

In some connection systems, the headers are provided with freestanding pins without any type of support surrounding the pins. In other connection systems, alignment plates are provided but are cumbersome in nature, as they add overall height to the socket connector. In other words, adding a vertical dimension of an alignment plate requires the overall height of the socket to increase, thereby increasing the overall material cost, as well as the area required to house the connection system.

Thus, the object of the invention is to provide the advantages of the alignment plate and the overall protection which it provides with a low-profile outline of a connection system.

The objects of the invention have been accomplished by providing an electrical connector comprising an insulative housing and a plurality of terminals. The housing provides a protective shroud around the terminals. An alignment plate is movable along the terminals in a mating direction of the terminals when mated with a complementary electrical connector. The terminals being mounted in an array on a printed circuit board, with the housing being attached to the printed circuit board. The alignment plate is movable from a first position adjacent to free ends of the terminals, to a second position adjacent the printed circuit board.

The connector further comprises locating elements on the alignment plate and on the protective shroud to position the alignment plate relative to the terminals. The locating elements can comprise locating lugs on the alignment plate, and channels surrounding a perimeter of the protective shroud profiled to receive the lugs. The alignment plate also includes stand-off features to hold the plate portion of the alignment plate slightly up off of said printed circuit board.

The electrical connector further comprises a latching element to latch the alignment plate in the first position. The electrical connector can also further comprise posts extending upwardly from the alignment plate for alignment with a complementary connector when mated to prevent misalignment.

In another aspect of the invention, an electrical connector assembly, comprises a socket connector comprising a plurality of socket terminals being mounted in an array on a printed circuit board; an insulative socket housing providing a protective shroud around the terminals; and an alignment plate being movable along the terminals in a mating direction of the terminals, the alignment plate being movable from a first position adjacent to free ends of the terminals, to a second position adjacent the printed circuit board. A mating plug connector comprises a plug housing profiled for mating reception in the protective shroud; and a plurality of plug terminals electrically connectable with the socket terminals.

The socket terminals are profiled as a plurality of posts upstanding from the printed circuit board. The plug housing has a front mating face with apertures complementarily located to receive the socket posts. The alignment plate further comprises insulative aligning posts upstanding therefrom and extending outwardly, and the plug housing front mating face including alignment openings to receive the aligning posts. The aligning posts extend out a distance greater than the socket terminal posts.

The plug and socket connectors have latching detents cooperatively provided on the socket and plug housings to temporarily hold the housings together in an unmated condition. The detents are provided on exterior endwalls of the plug housing, and on interior endwalls of the socket housing. The detents are so positioned on the socket and plug housings such that when the housings are held by the detents, the aligning posts are partially inserted in respective alignment openings, but the socket and plug terminals are disengaged.

The electrical connector assembly further comprises a latching assembly cooperatively provided by the socket housing and the alignment plate to latch the alignment plate in the first position. The plug housing includes a disengagement element to disengage the latching assembly, to allow the alignment plate to be moved to the second position by the movement of the plug housing.

In yet another embodiment of the invention, an electrical connector, comprises a plurality of socket terminals being mounted in an array on a printed circuit board; an insulative shroud around the terminals; and an alignment plate being movable along the terminals in a mating direction of the terminals, the alignment plate being movable from a first position adjacent to free ends of the terminals, to a second position against the printed circuit board.

The electrical connector further comprises locating elements on the alignment plate and on the protective shroud to position the alignment plate relative to the terminals. The electrical connector further comprises a latching element to latch the alignment plate in the first position. The electrical connector further comprising posts extending upwardly from the alignment plate for alignment with a complementary connector when mated to prevent misalignment.

DETAILED DESCRIPTION OF THE PREFERRED EMBODIMENT

Figure 1:
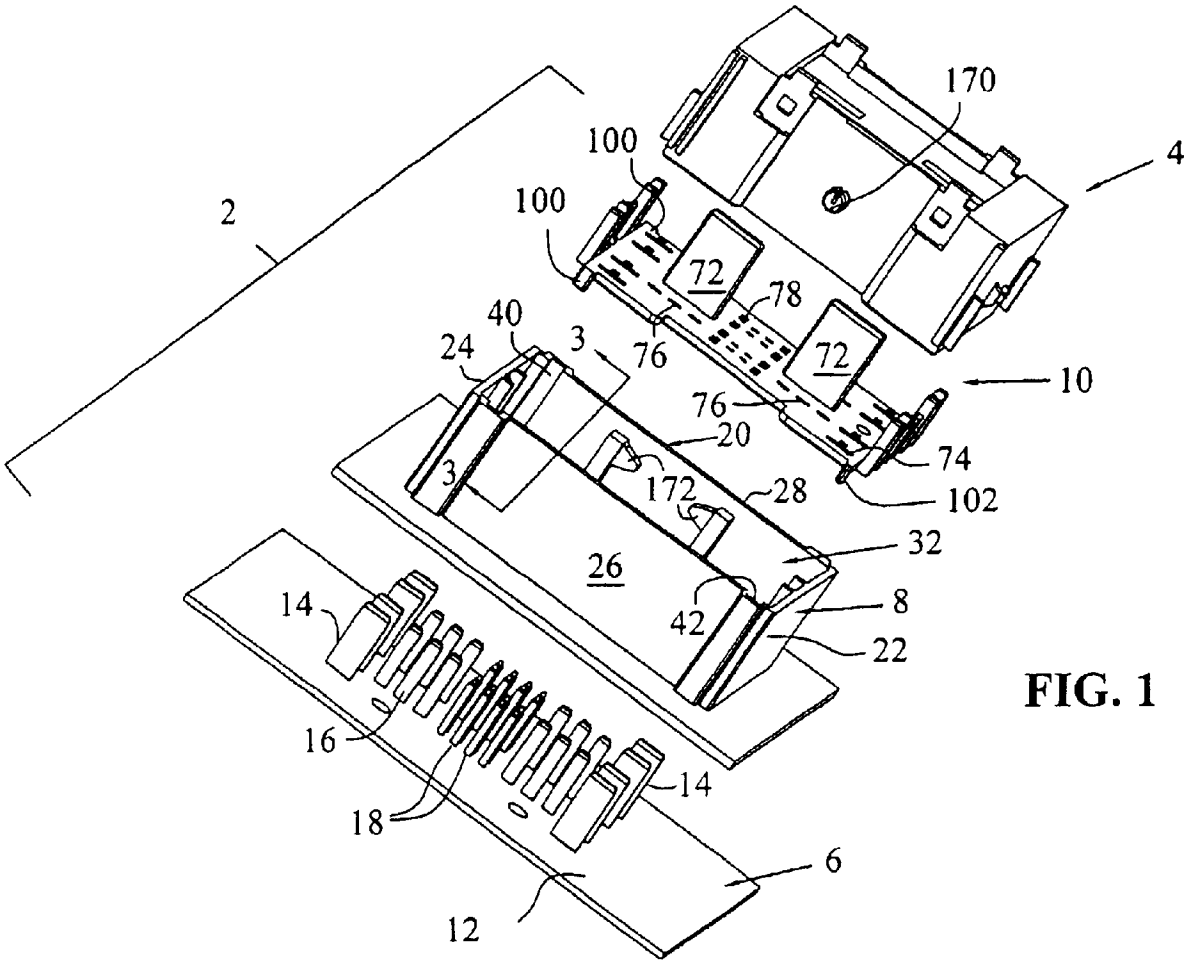
FIG. 1 is an exploded view of the socket and plug connector housings.

With reference first to FIG. 1, a socket housing assembly is shown at 2 as an exploded view, which is profiled to receive a plug assembly shown generally at 4. The socket housing 2 is composed of a printed circuit board assembly 6, a module housing 8, and an alignment plate 10. With respect now to the various drawings, the individual components will now be described in greater detail.

Figure 2:
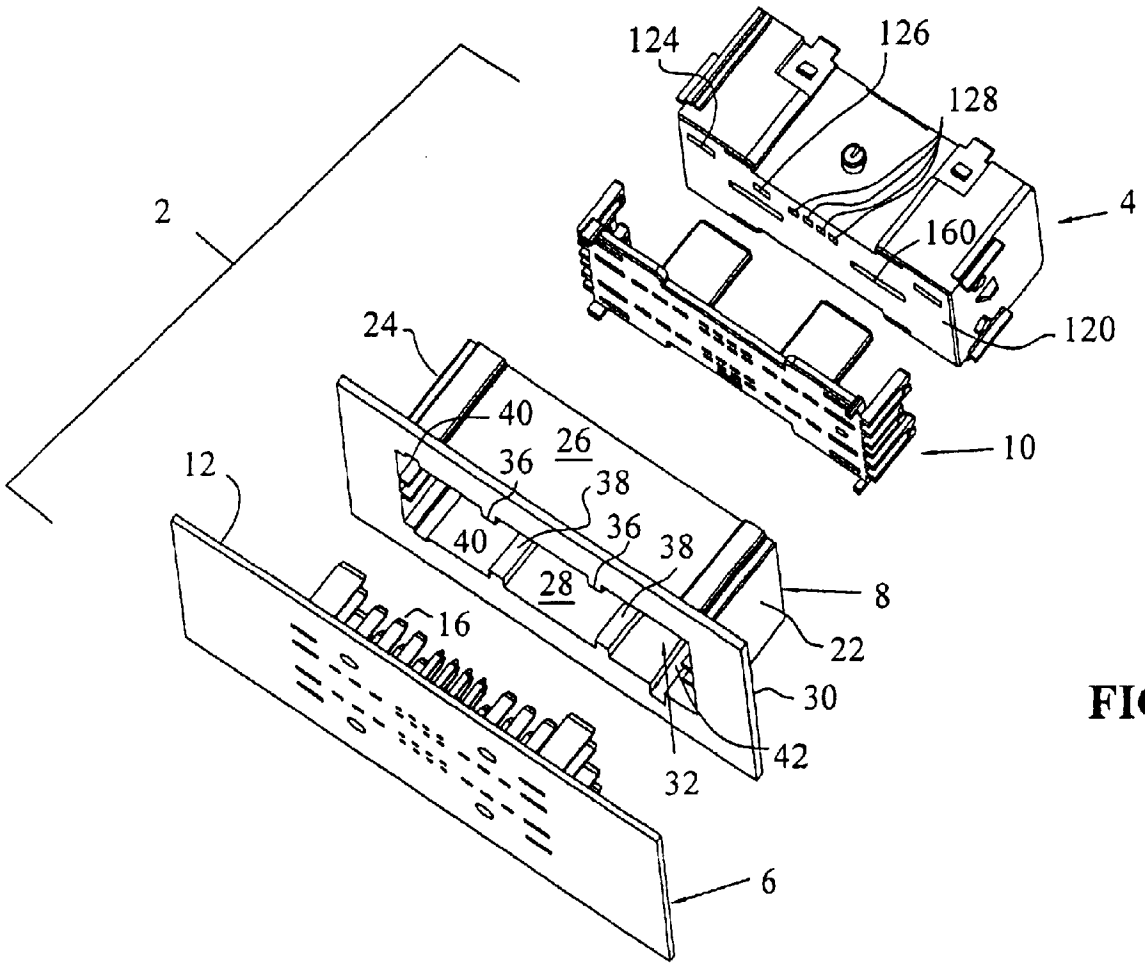
FIG. 2 is a view similar to that of FIG. 1 from a below different perspective.

With reference to FIGS. 1 and 2, the printed circuit board assembly includes a printed circuit board 12 having mounted thereon, an array of terminals, for example, large tab terminals 14, tabs 16, and pin contacts 18. It should be appreciated that the various tabs 14, 16 and pin contacts 18 can be connected to traces on the circuit board for interconnection to other various components in a known manner. For example, the printed circuit board 12 could include edge, traces to which edge card connectors are connected to printed circuit board 12, or other pin contacts could be established in another array for interconnection to the contacts 14–18.

As shown in FIGS. 1 and 2, the module housing 8 generally includes an open frame wall 20 including end walls 22, 24 and side walls 26 and 28. The module housing 8 further includes a lower flange portion 30, which circumscribes an interior opening 32 within the module housing 8, as will be described herein. As shown best in FIG. 2, module housing 8 includes two alignment ribs 36 positioned on an inside of wall 26, and two alignment ribs 38 positioned adjacent to wall 28, as will be described further herein. As also shown in FIG. 2, module housing 8 includes alignment channels 40 at one end and channels 42 at the opposite end, both sets of channels being positioned within an inside surface of wall 26 and 28, respectively.

Figure 3:
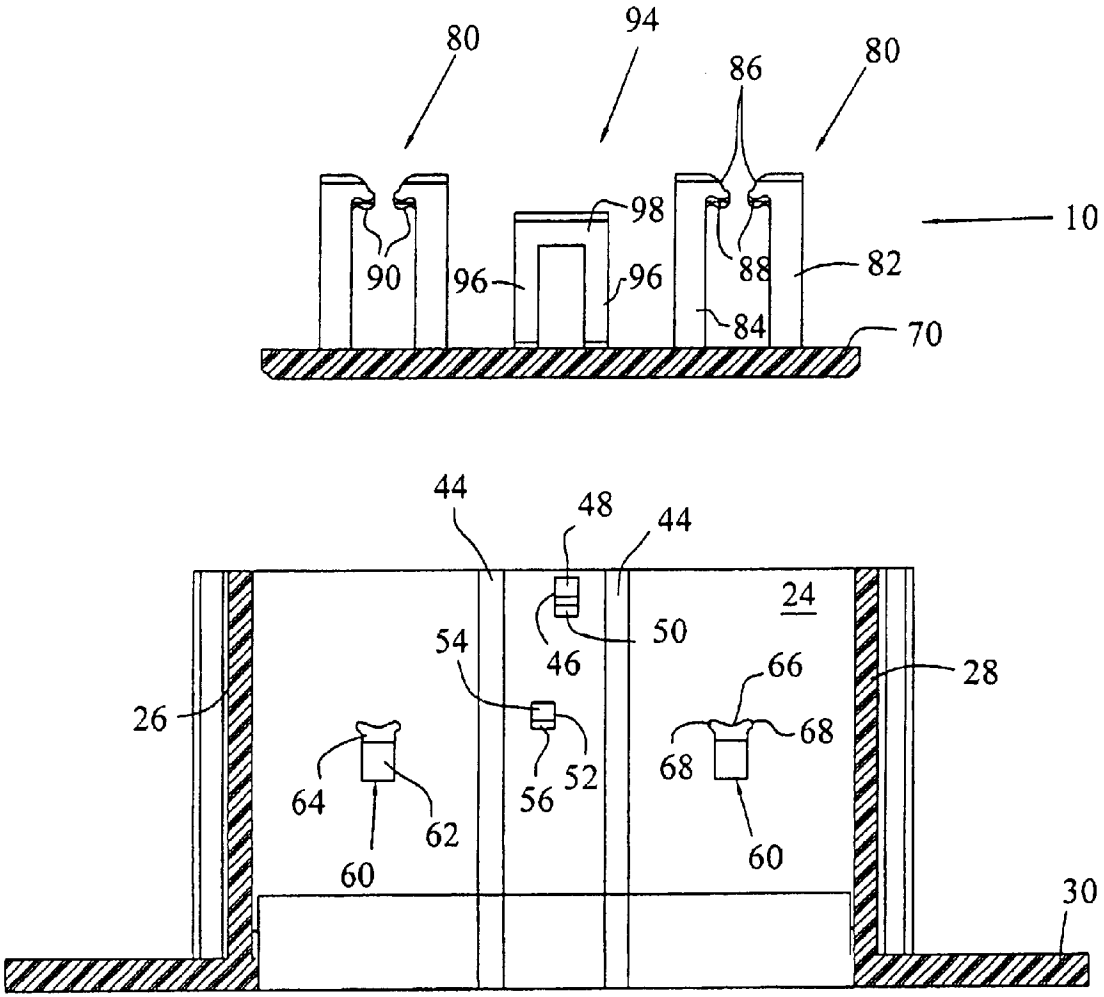
FIG. 3 is a cross-sectional view through lines 3—3 of FIG. 1 showing the module housing and alignment plate in cross section.

With respect now to FIG. 3, which is a cross-sectional view through lines 3—3 of FIG. 1, an inside view of wall 24 is shown to include two elongated alignment ribs 44, which flank a detent member 46, having ramped surfaces 48 and 50, and a latch projection 52 having a ramped surface at 54 and a horizontally extending latch surface 56. Two latched detents 60 are also provided having a ramp portion at 62, which enlarges to an upstanding portion at 64. The enlarged portion 64 has a V-shaped upper surface at 66 and lateral projections extending therefrom at 68.

With respect now to FIGS. 1 and 3, alignment plate 10 is shown in greater detail as including a plate portion 70 having upstanding anti-scoop members 72 and a plurality of passageways through the plate, for example, at 74, 76, and 78. It should be appreciated that the apertures 74 are profiled to receive tabs 14; apertures 76 profiled to receive tabs 16, and apertures 78 profiled to receive pins 18. As shown now in FIG. 3, alignment plate 10 further includes two flexible spring arm latches shown generally at 80, where the latches are comprised of upstanding spring arms, for example, at 82 and 84. It should be appreciated that the latch arms 82, 84 are identical to each other but a mirror image of each other. As shown in FIG. 3, spring arms 82, 84 include ramped surfaces at 86, lower locking surfaces 88, and an outer overlapping wall at 90. Alignment plate 10 also includes an intermediate flexible latch 94 including two upstanding leg portions 96 and a horizontal bar section at 98. It should be appreciated that the alignment plate has latches 80 and 94 at each end of the plate, as shown in either of FIG. 1 or 2. Finally, as shown in FIG. 1, alignment plate 10 includes locating lugs at 100, 102. As shown best in FIG. 8, lugs 100, 102 provide laterally extending portions 104, 106 and standoff surfaces 107, 108.

Figure 4:
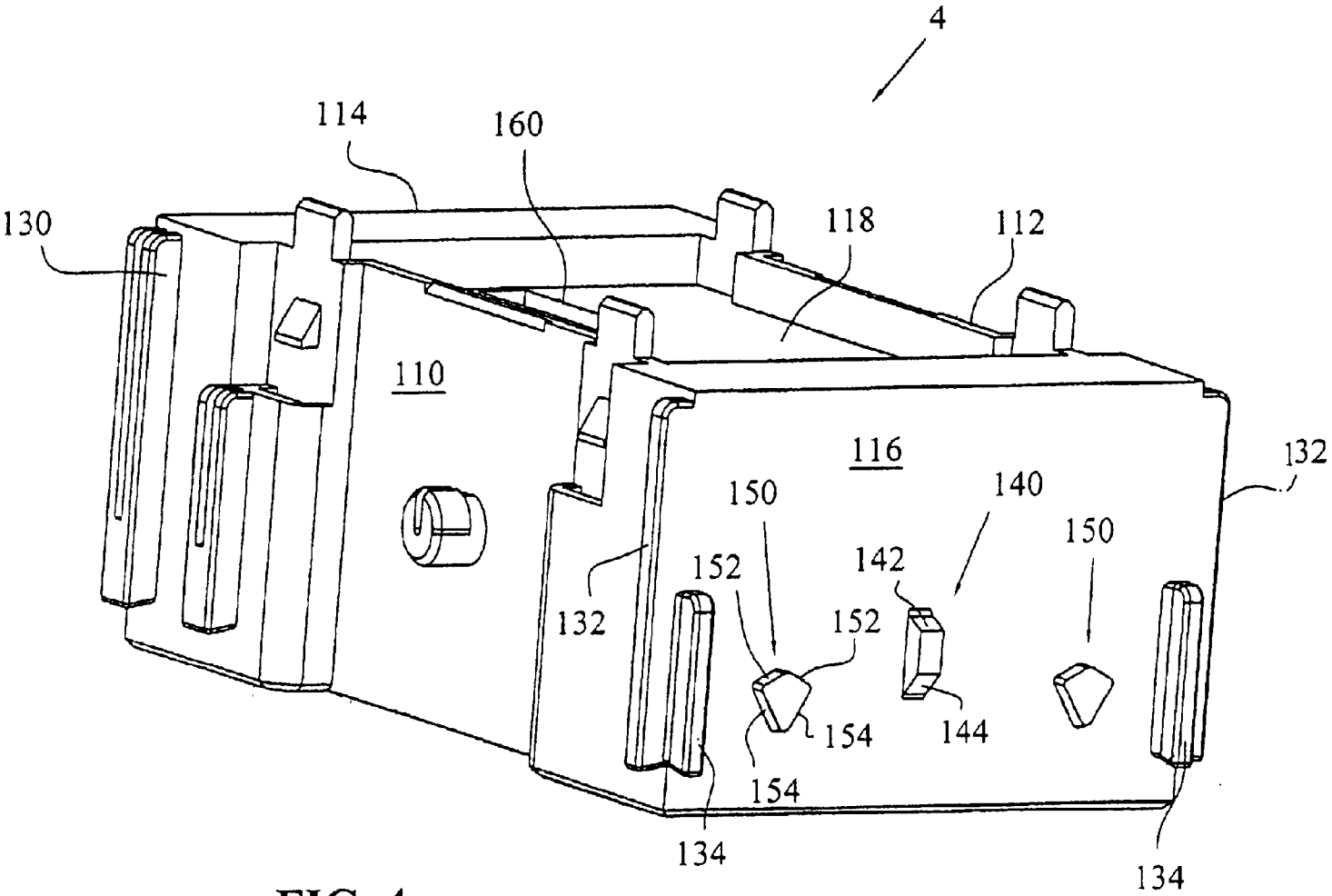
FIG. 4 is a perspective view of the plug housing from a perspective showing the end wall in greater detail.
Figure 5:
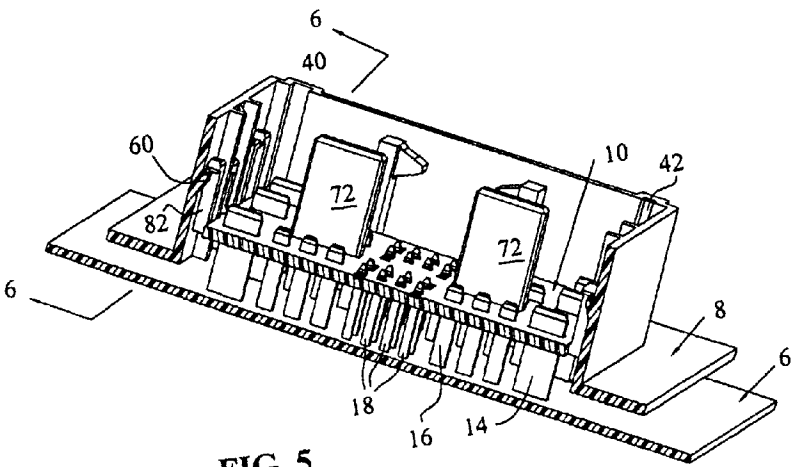
FIG. 5 is a cut-away view of the printed circuit board, module housing and alignment plate.

As shown in FIG. 4, plug housing 4 is shown in greater detail as having general side walls at 110, 112 and end walls 114, 116. Socket housing 4 further includes a top wall 118 and a lower wall 120 (FIG. 2) having apertures 124, 126, and 128, where apertures 124, 126, and 128 are profiled to receive respective terminals 14, 16, and 18. Side wall 110 includes an alignment rib 130 and wall 112 includes a similar rib (not shown), and wall 110 includes spacer ribs at 132; and end wall 116 includes spacer ribs at 134. Each end wall 114, 116 includes a central detent member 140 having upper and lower ramp surfaces 142 and 144. Furthermore, both end walls 114 and 116 include a pair of diamond-shaped projections 150, where each projection includes upper surfaces 152 having little slope and surfaces 154 having a large slope, as will be described herein. Finally, upper surface 118 and lower surface includes openings 160 extending therethrough, and which are profiled to receive anti-scoop protection members 72. With the above description of the various components, the assembly of the connectors will now be described herein below.

Figure 6:
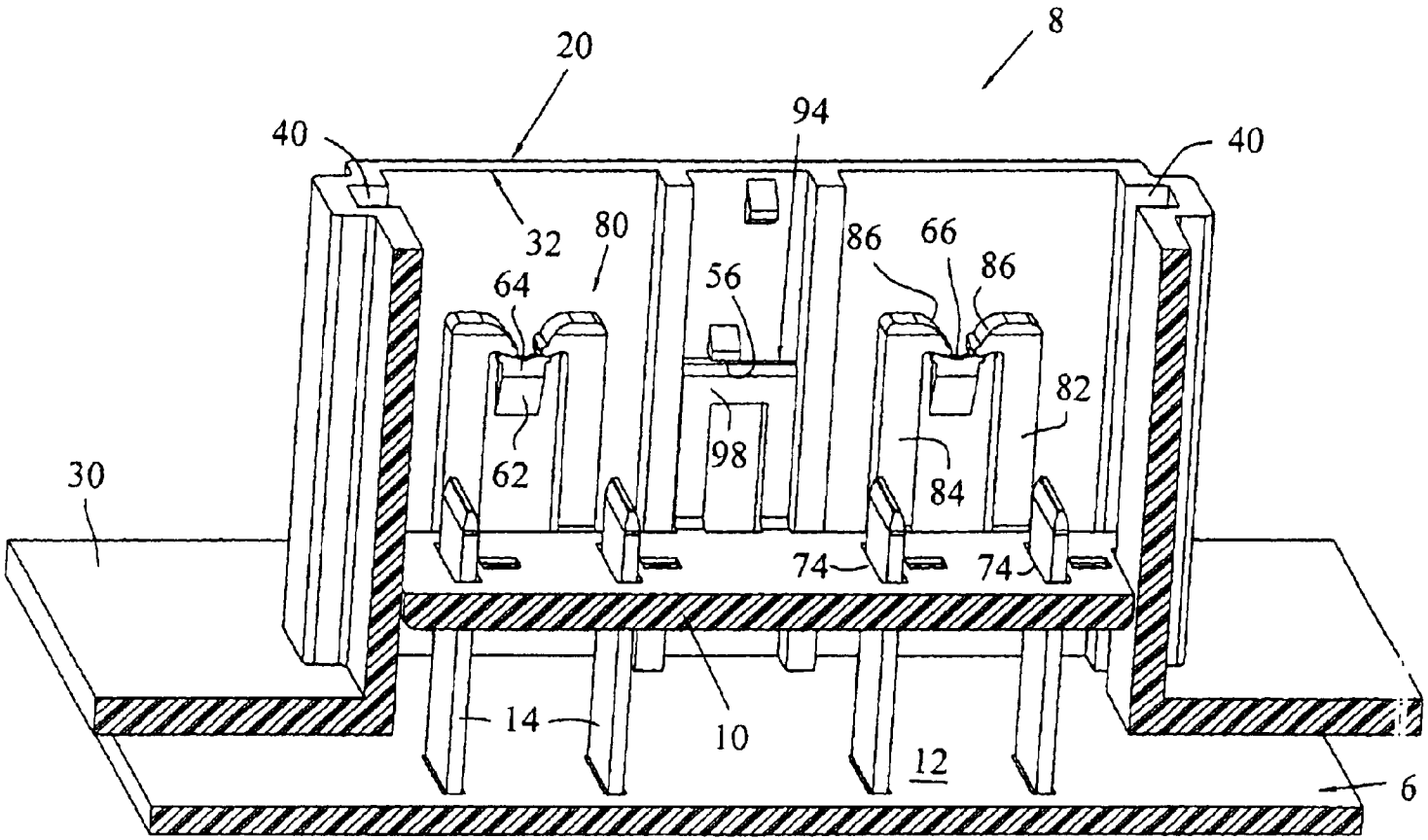
FIG. 6 is a cross-sectional view through lines 6—6 of FIG. 5.
Figure 7:
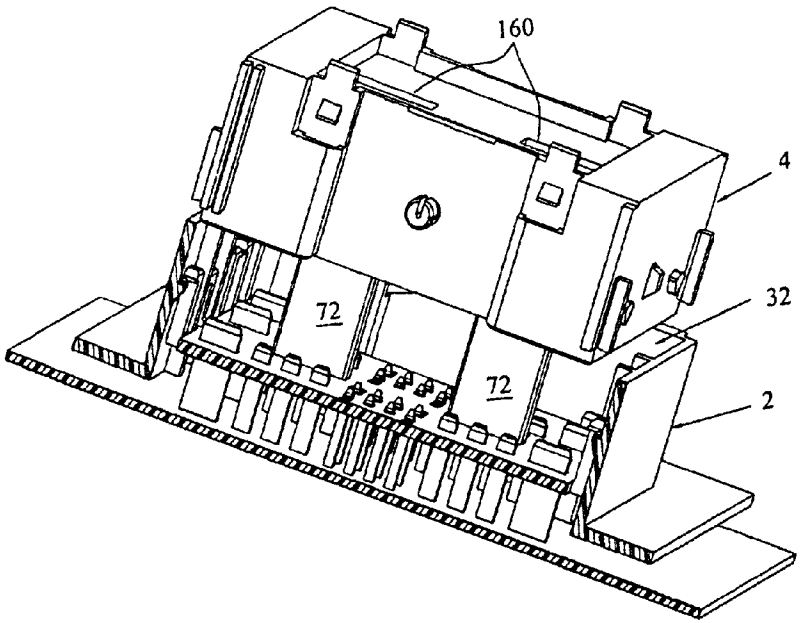
FIG. 7 is a view similar to that of FIG. 5 showing the plug housing poised for receipt within the module housing.

With reference first to FIG. 6, the printed circuit board is shown with the various tabs (only tabs 14 are shown) positioned within cavity 32 and with alignment plate 10 shown partially inserted therein. As shown, alignment plate 10 has tabs 14 partially inserted within apertures 74. Alignment plate 10 is also shown fixed in a preliminarily locked position by way of latch members 80 and 94. More particularly, latch shoulders 90 (FIG. 3) are hanging on the V-shaped surface 66 (FIG. 3) and bar portion 98 of latch 94 is snapped beneath latch surface 56. It should be appreciated from FIG. 6, however, that the resilient arms 82, 84, particularly at the position of surfaces 86, has a greater depth or thickness than latch body portion 64. When in the position of FIG. 6, plug housing 4 can be positioned within cavity 32 such that apertures 160 align in all three axes with anti-scoop features 72 to align the plug housing 4 with the socket housing 2 prior to any engagement with the various tab contacts. As best shown in FIG. 7, it should be clear that the anti-scoop features extend higher than any of the tab contacts 14, 16, 18.

Figure 8:
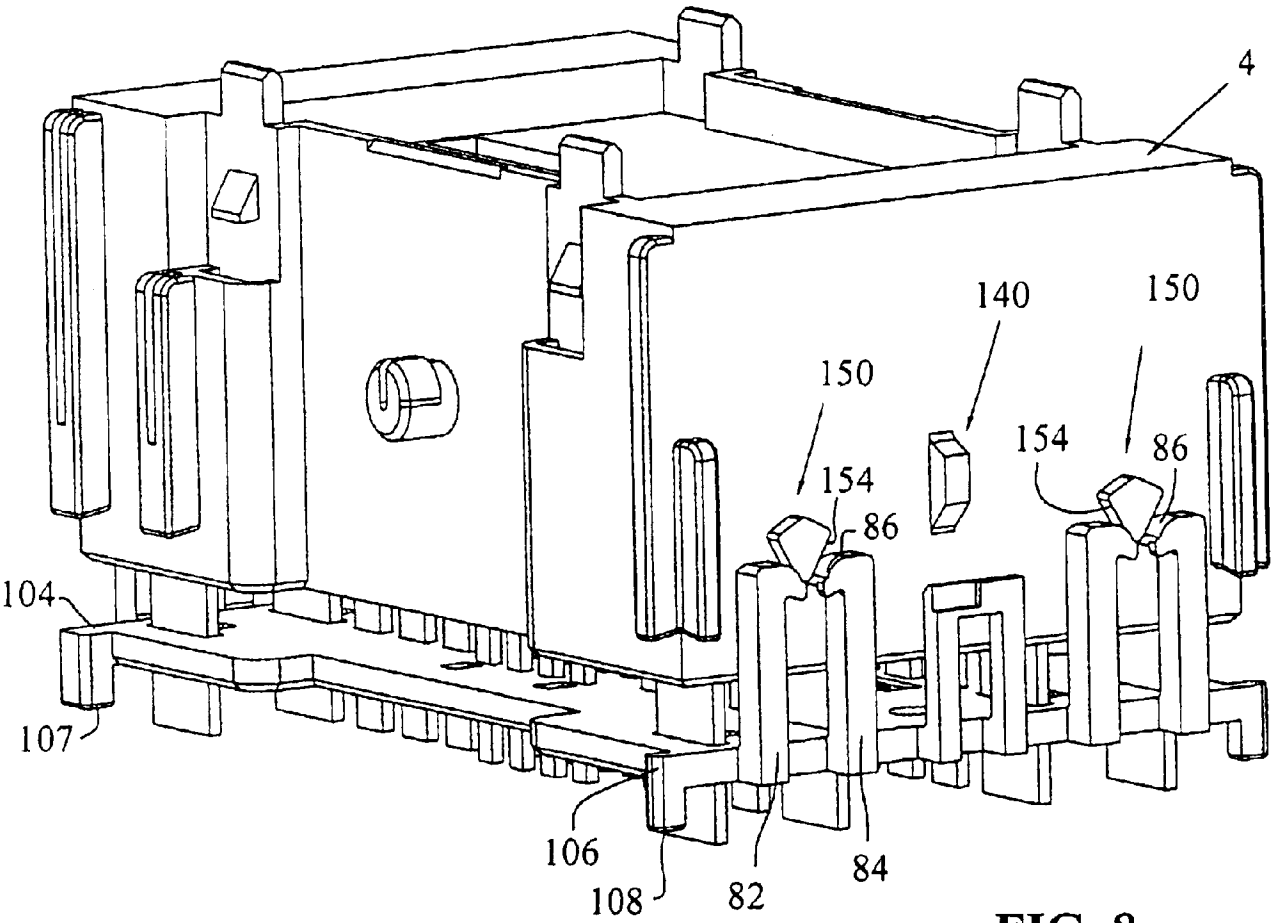
FIG. 8 shows a perspective view of the plug housing cooperating with the latches on the alignment plate, but less the module housing and printed circuit board.

With respect now to FIG. 8 (which is shown without the printed circuit board 6 and housing 8), continued movement of the plug housing causes diamond-shaped lugs 150 to engage surfaces 86 of flexible latch arms 82 and 84. Further movement downward of plug housing 4 causes outward rotation or bowing of arms 82 and 84 such that plug housing 4 moves from the position shown in FIG. 8 to the position shown in FIG. 9. When in the position of FIG. 9, the standoff surfaces would contact the printed circuit board in a bottom-out position. It should be appreciated that the printed circuit board and tab contacts may have solder fillets, and the standoffs prevent the alignment plate 10 from sticking to the fillets. The lugs also provide stability generally to the alignment plate, and help prevent the alignment plate from binding in the socket housing 8.

Figure 9:
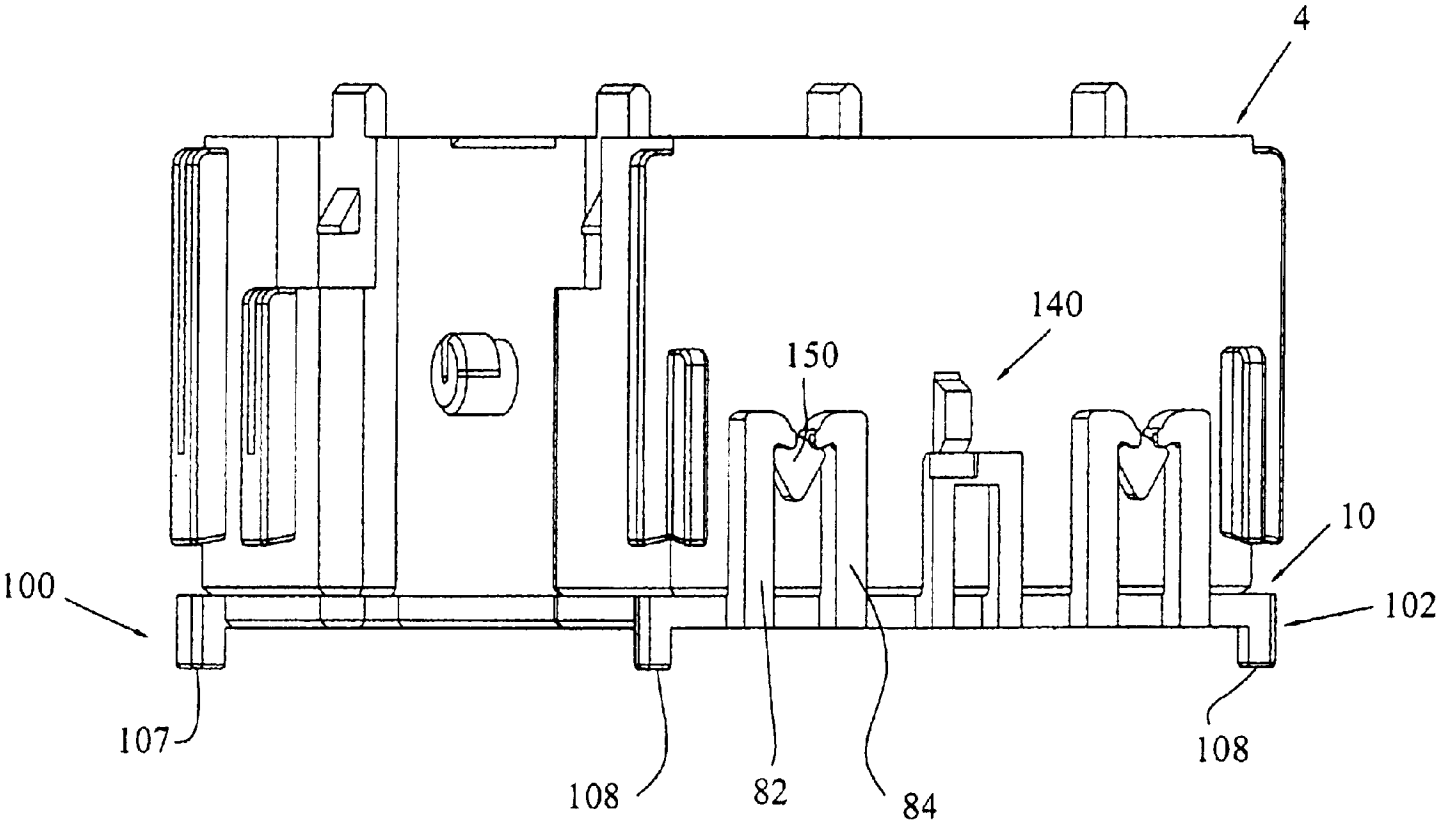
FIG. 9 shows a view similar to that of FIG. 8 showing the plug housing in the fully latched position.

Furthermore, as mentioned above, the slope of the ramped surfaces 152 (FIG. 4) is much less than that of surfaces 154. The slope of surfaces 152 is chosen such that the force to extract the plug connector from the position of FIG. 9 is greater than the sum of the forces to withdraw the plug housing as it relates to the frictional engagement of the various contacts. Thus, during the first portion of the retraction of the plug connector 4, the alignment plate is also retracted back to the position shown in FIG. 6. Continued retraction of the plug housing 4 causes the interference of surfaces 152 (FIG. 4) and surfaces 88, again spreading the arms 82 and 84 apart, allowing the full retraction of the plug housing 4.

In the preferred embodiment, the insertion and retraction mechanism can be a rack and pinion system including a rotatable lever member on posts 70, which is cooperable with rack teeth 172, although any type of assist feature could be employed. It should also be noted that the connector assembly could also be hand mateable, where the plug and socket connectors are merely pushed together by hand.

Advantageously then, and as best shown in FIG. 6, the design offers a simplified module, which is more cost effective, easier to assemble, and has a lower profile. Because the socket module 8 does not include a floor, the alignment plate 10 can move vertically downward to the position where it reaches the printed circuit board 12. If the socket module contained a floor, the alignment plate would only have the vertical clearance to reach the top of the floor. This would also create a situation where the tab and pin terminals would require a longer length upstanding into the socket module causing greater probability of stubbing and/or damage to the contacts, as well as increased material cost. Moreover, due to the nonexistence of the floor on the module housing, the design is greatly simplified and assembly is made much simpler.

What is claimed is:

1. An electrical connector comprising an insulative housing and a plurality of terminals, the housing providing a protective shroud around said terminals, and an alignment plate member, said alignment plate member being movable along said terminals in a mating direction of said terminals when mated with a complementary electrical connector, said terminals being mounted in an array on, and electrically connected to, a printed circuit board, with said housing being attached to said printed circuit board, said shroud having an open bottom exposing said printed circuit board, said alignment plate member being movable from a first position adjacent to free ends of said terminals, to a second position adjacent said printed circuit board.

2. The electrical connector of claim 1, further comprising a latching element to latch said alignment plate in said first position.

3. The electrical connector of claim 1, further comprising posts extending upwardly from said alignment plate for alignment with a complementary connector when mated to prevent misalignment.

4. The electrical connector of claim 1, further comprising locating elements on said alignment plate member and on said protective shroud to position said alignment plate member relative to said terminals.

5. The electrical connector of claim 4, wherein said locating elements on said alignment plate provide a stand-off feature which contacts the printed circuit board.

6. The electrical connector of claim 4, wherein said locating elements comprise locating lugs on said alignment plate member, and channels surrounding a perimeter of said protective shroud profiled to receive said lugs, said lugs having a laterally extending portion and a stand-off foot portion.

7. An electrical connector assembly, comprising:

a socket connector comprising:

a plurality of socket terminals being mounted in an array on, and electrically connected to a printed circuit board;

an insulative socket housing providing a protective shroud around said terminals; and an alignment plate being movable along said terminals in a mating direction of said terminals, the alignment plate being movable from a first position adjacent to free ends of said terminals, to a second position proximate said printed circuit board; and a plug connector comprising:

a plug housing profiled for mating reception in said protective shroud; and a plurality of plug terminals electrically connectable with said socket terminals.

8. The assembly of claim 7, wherein the socket terminals are profiled as a plurality of posts upstanding from said printed circuit board.

9. The assembly of claim 8, wherein said plug housing has a front mating face with apertures complementarily located to receive said socket posts.

10. The assembly of claim 9, wherein said alignment plate further comprises insulative aligning posts upstanding therefrom and extending outwardly, and the plug housing front mating face including alignment openings to receive said aligning posts.

11. The assembly of claim 10, wherein said aligning posts extend out a distance greater than said socket terminal posts.

12. The assembly of claim 10, wherein said plug and socket connectors having latching detents cooperatively provided on the socket and plug housings to temporarily hold the housings together in an unmated condition.

13. The assembly of claim 12, wherein said detents are provided on exterior endwalls of said plug housing, and on interior endwalls of said socket housing.

14. The assembly of claim 12, wherein said detents are so positioned on said socket and plug housings such that when said housings are held by said detents, said aligning posts are partially inserted in respective alignment openings, but said socket and plug terminals are disengaged.

15. The assembly of claim 7, further comprising a latching assembly cooperatively provided by said socket housing and said alignment plate to latch said alignment plate in said first position.

16. The assembly of claim 15, wherein said plug housing includes a disengagement element to disengage said latching assembly, to allow said alignment plate to be moved to said second position by the movement of said plug housing.

17. An electrical connector, comprising:

a plurality of socket terminals being mounted in an array on a printed circuit board;

an insulative shroud around said terminals, said shroud having an open bottom, said shroud being mounted directly to said printed circuit board, exposing said printed circuit board through said shroud; and an alignment plate being movable along said terminals in a mating direction of said terminals, the alignment plate being movable from a first position adjacent to free ends of said terminals, to a second position against said printed circuit board.

18. The electrical connector of claim 17, further comprising locating elements on said alignment plate and on said protective shroud to position said alignment plate relative to said terminals.

19. The electrical connector of claim 17, further comprising a latching element to latch said alignment plate in said first position.

20. The electrical connector of claim 17, further comprising posts extending upwardly from said alignment plate for alignment with a complementary connector when mated to prevent misalignment.

* * * * *